US008303717B2

(12) United States Patent
Tamura et al.

(10) Patent No.: US 8,303,717 B2
(45) Date of Patent: Nov. 6, 2012

(54) ALKALI-TYPE NONIONIC SURFACTANT COMPOSITION

(75) Inventors: Atsushi Tamura, Wakayama (JP); Sadaharu Miyamoto, Wakayama (JP); Yasunori Horio, Wakayama (JP)

(73) Assignee: Kao Corporation, Tokyo (JP)

( * ) Notice: Subject to any disclaimer, the term of this patent is extended or adjusted under 35 U.S.C. 154(b) by 196 days.

(21) Appl. No.: 12/678,054

(22) PCT Filed: Sep. 5, 2008

(86) PCT No.: PCT/JP2008/066105

§ 371 (c)(1), (2), (4) Date: Mar. 12, 2010

(87) PCT Pub. No.: WO2009/034932

PCT Pub. Date: Mar. 19, 2009

(65) Prior Publication Data

US 2010/0255410 A1 Oct. 7, 2010

(30) Foreign Application Priority Data

Sep. 14, 2007 (JP) ..... 2007-239680

(51) Int. Cl.
*C11D 1/02* (2006.01)

(52) U.S. Cl. ..... 134/1; 510/207; 510/245

(58) Field of Classification Search ..... 134/1; 510/207, 510/245

See application file for complete search history.

(56) References Cited

U.S. PATENT DOCUMENTS

| | | | | |
|---|---|---|---|---|
| 5,750,482 | A * | 5/1998 | Cummings | 510/182 |
| 5,929,008 | A * | 7/1999 | Goldstein | 510/221 |
| 6,103,300 | A | 8/2000 | Yoshida et al. | |
| 6,306,249 | B1 * | 10/2001 | Galante et al. | 162/4 |
| 6,342,473 | B1 * | 1/2002 | Kott et al. | 510/357 |
| 6,425,959 | B1 * | 7/2002 | Man | 134/39 |
| 6,800,600 | B1 * | 10/2004 | Strothoff et al. | 510/404 |
| 7,918,941 | B2 * | 4/2011 | Tamura et al. | 134/1.3 |
| 2008/0015133 | A1 * | 1/2008 | Rigley et al. | 510/215 |
| 2009/0312219 | A1 * | 12/2009 | Tamura et al. | 510/245 |

FOREIGN PATENT DOCUMENTS

| | | | |
|---|---|---|---|
| JP | 8-73890 | A | 3/1996 |
| JP | 8-157871 | A | 6/1996 |
| JP | 10-199047 | A | 7/1998 |
| JP | 2002-294300 | A | 10/2002 |
| JP | 2007-16132 | A | 1/2007 |
| JP | 2007-95238 | A | 4/2007 |
| JP | 2007-284508 | A | 11/2007 |
| JP | 2007-291328 | A | 11/2007 |

OTHER PUBLICATIONS

Chinese Office Action (including full English translation), dated Jul. 6, 2012, issued in corresponding CN Patent Application No. 200880106764.1.

* cited by examiner

*Primary Examiner* — Gregory Webb
(74) *Attorney, Agent, or Firm* — Birch, Stewart, Kolasch & Birch, LLP

(57) ABSTRACT

An alkali-type nonionic surfactant composition contains a nonionic surfactant (component A), water (component B), at least one compound (component C) selected from the group consisting of benzenesulfonic acid, toluenesulfonic acid, dimethylbenzenesulfonic acid, hydroxybenzenesulfonic acid and salts thereof, and at least one alkaline chemical (component D) selected from the group consisting of potassium hydroxide and sodium hydroxide. The alkali-type nonionic surfactant composition contains the nonionic surfactant (component A) in an amount of 0.5 to 20 wt % and has a pH at 25° C. of 12 or greater.

5 Claims, 5 Drawing Sheets

ALKALI-TYPE NONIONIC SURFACTANT COMPOSITION

TECHNICAL FIELD

The present invention relates to an alkali-type nonionic surfactant composition and a hard-surface cleaning agent consisting thereof. Moreover, the present invention relates to a method for cleaning a hard surface, a method for producing a substrate, a method for producing a recording medium, a method for producing a photomask and a method for producing a flat-panel display substrate, all performed using the aforementioned hard-surface cleaning agent. Furthermore, the present invention relates to a method for preserving a nonionic surfactant-containing alkaline composition.

BACKGROUND ART

Patent Document 1 discloses, in order to enhance low-temperature storage stability without deteriorating cleaning property and foaming power, a surfactant composition whose pH is neutral or acidic and that contains a polyvalent carboxylic acid-based chelating agent, a specific nonionic surfactant and a compound selected from benzenesulfonic acids (salts) and benzenecarboxylic acids (salts) in which hydrogen atoms may be substituted with an alkyl group having a carbon number of 1 to 3 or hydroxyl group.

Patent Document 1: JP 2007-16132 A

DISCLOSURE OF INVENTION

Problem to be Solved by the Invention

Nonionic surfactant-containing surfactant compositions include not only those that are stored and used in a neutral or acidic state, such as the surfactant composition disclosed in Patent Document 1, but also those that are stored and used in an alkaline state, and it is presumed that there are many applications for such surfactant compositions. In particular, since the targets of cleaning have been becoming smaller and smaller in industrial applications, a need, from the viewpoint of enhanced cleaning property, for an alkali-type nonionic surfactant composition that is stored and used in a very strong alkaline state (hereinafter sometimes simply referred to as a "surfactant composition") is increasing.

For example, in regard to hard disk drives for use in various applications such as personal computers, portable music players and the like, demand exists for greater storage capacity, smaller diametrical size of disk drives and lighter weight. Accordingly, for about the past five years in particular, the recording density of recording media for use as hard disk drives has increased significantly, and the requirement for the extent of cleaning of the substrate surface of recording media has been increasingly stringent. Therefore, it is desired that foreign substances such as fine particles on the substrate surface are sufficiently cleaned away. Moreover, surfactant compositions for use in cleaning substrate surfaces are required to have high storage stability.

In a system that contains large amounts of an alkaline chemical in order to attain alkalinity, the cloud point is significantly lowered as a nonionic surfactant changes in properties over time. Therefore, it is very important to ensure the storage stability of an alkali-type nonionic surfactant composition. Moreover, in industrial applications in particular, high-temperature storage stability is more important than low-temperature storage stability. For example, even if an alkali-type nonionic surfactant composition is produced under an appropriately controlled temperature, it is necessary to consider that the alkali-type nonionic surfactant composition may be transported or used under summer-time high temperatures.

The present invention provides an alkali-type nonionic surfactant composition that exhibits good storage stability at relatively high temperatures, and a hard-surface cleaning agent consisting thereof. Moreover, the present invention provides a method for cleaning a hard surface, a method for producing a substrate, a method for producing a recording medium, a method for producing a photomask and a method for producing a flat-panel display substrate, all performed using the aforementioned hard-surface cleaning agent. Furthermore, the present invention provides, in connection with a nonionic surfactant-containing alkaline composition, a preservation method that can inhibit the deterioration of cleaning property in storage under relatively high temperatures.

Means for Solving Problem

The alkali-type nonionic surfactant composition of the present invention contains a nonionic surfactant (component A), water (component B), at least one compound (component C) selected from the group consisting of benzenesulfonic acid, toluenesulfonic acid, dimethylbenzenesulfonic acid, hydroxybenzenesulfonic acid and salts thereof; and at least one alkaline chemical (component D) selected from the group consisting of potassium hydroxide and sodium hydroxide. The amount of the nonionic surfactant (component A) contained is 0.5 to 20 wt %, and the pH at 25° C. is 12 or greater.

The hard-surface cleaning agent of the present invention consists of the alkali-type nonionic surfactant composition of the present invention.

The method for cleaning a hard-surface of the present invention includes the step of cleaning a hard surface using the hard-surface cleaning agent of the present invention, and in the step, the hard-surface cleaning agent is supplied to the hard surface by immersing the hard surface in the hard-surface cleaning agent and/or injecting the hard-surface cleaning agent.

The method for producing a substrate of the present invention includes: the step of cleaning, using the hard-surface cleaning method of the present invention, a substrate to be cleaned that has a metal surface or a glass surface and that has undergone polishing of the surface using a polishing slurry.

The method for producing a recording medium of the present invention is a method for producing a recording medium containing a recording medium substrate and a magnetic layer disposed on one principal surface side of the recording medium substrate or magnetic layers disposed respectively on both principal surface sides thereof. The method includes a substrate forming step of forming the recording medium substrate by performing on a substrate to be polished a polishing treatment and a cleaning treatment several times in this order, and a magnetic layer forming step of forming the at least one magnetic layer, and in carrying out the final run of the cleaning treatment that is performed several times, a polished substrate is cleaned using the hard-surface cleaning agent of the present invention.

The method for producing a photomask of the present invention is a method for producing a photomask containing a glass substrate and a shading metal pattern layer disposed on one principal surface side of the glass substrate. The method includes the step of forming the glass substrate by performing on a substrate to be polished a polishing treatment and a cleaning treatment several times in this order, and the step of forming the shading metal pattern layer on the glass substrate, and in carrying out the final run of the cleaning treatment that is performed several times, a polished substrate is cleaned using the hard-surface cleaning agent of the present invention.

The method for producing a flat-panel display substrate of the present invention is a method for producing a flat-panel display substrate containing a glass substrate and an electrode layer disposed on the glass substrate. The method includes the step of forming the glass substrate by performing on a substrate to be polished a polishing treatment and a cleaning treatment several times in this order, and the step of forming the electrode layer on the glass substrate, and in carrying out the final run of the cleaning treatment that is performed several times, the polished substrate is cleaned using the hard-surface cleaning agent of the present invention.

The method for preserving a nonionic surfactant-containing alkaline composition of the present invention is a method for preserving a nonionic surfactant-containing alkaline composition containing a nonionic surfactant (component A), water (component B) and at least one alkaline chemical (component D) selected from the group consisting of potassium hydroxide and sodium hydroxide. The method causes at least one compound (component C) selected from the group consisting of benzenesulfonic acid, toluenesulfonic acid, dimethylbenzenesulfonic acid, hydroxybenzenesulfonic acid and salts thereof to be concomitantly present with the nonionic surfactant-containing alkaline composition, and the amount of the nonionic surfactant contained is 0.5 to 20 wt % of the total amount of the nonionic surfactant-containing alkaline composition and the component C, and the pH of the mixture of the nonionic surfactant-containing alkaline composition and the component C at 25° C. is 12 or greater.

DESCRIPTION OF PREFERRED EMBODIMENTS

Surfactant Composition

Figure 1:
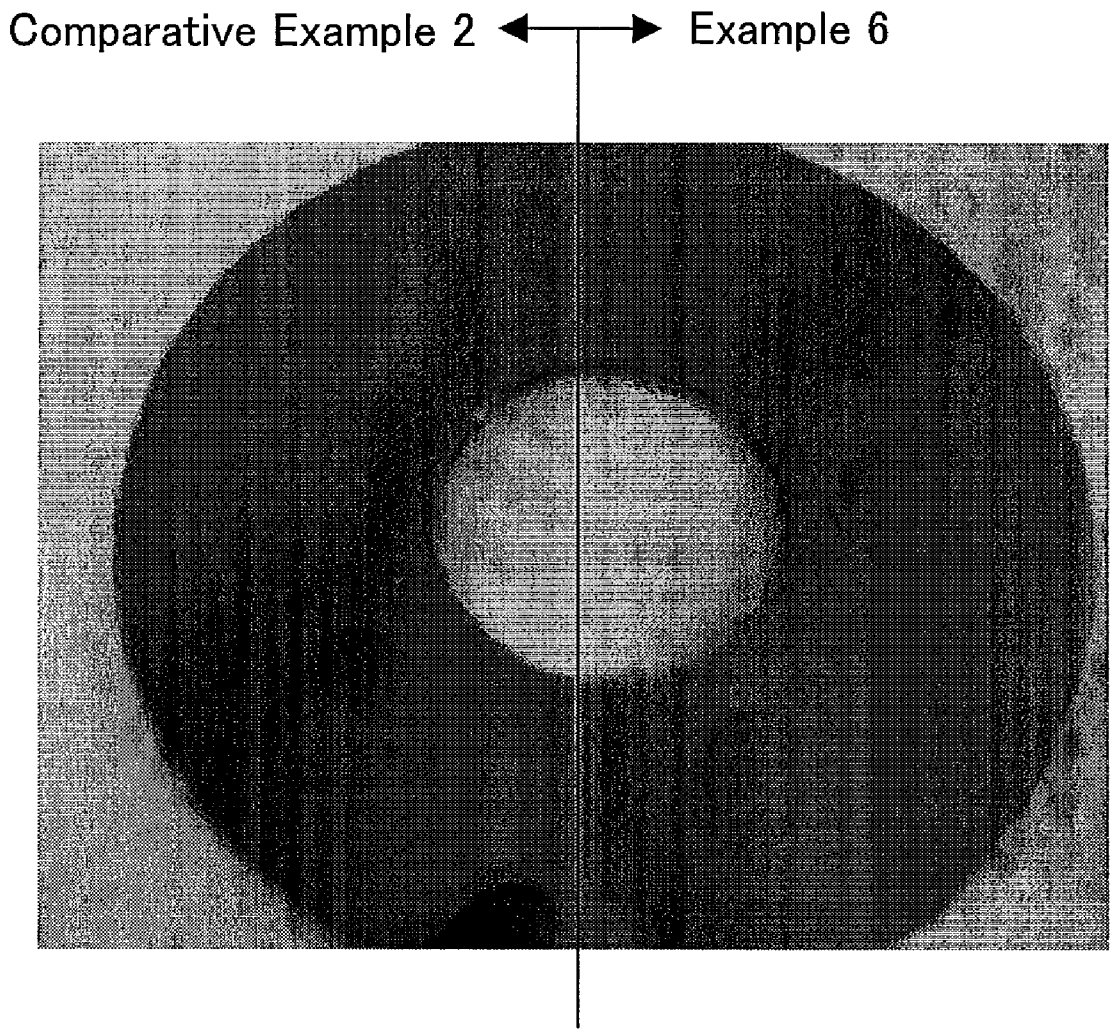
FIG. 1 is a photograph showing the appearance of the surface of a substrate to be cleaned onto which a hard-surface cleaning agent consisting of the surfactant composition of Example 6 and a hard-surface cleaning agent consisting of the surfactant composition of Comparative Example 2 were dripped.

There is a problem that when a nonionic surfactant-containing alkaline composition that contains a nonionic surfactant (component A), water (component B) and at least one alkaline chemical (component D) selected from the group consisting of potassium hydroxide and sodium hydroxide and that has high alkalinity is stored under relatively high temperatures, the composition becomes cloudy and undergoes a property change, thereby deteriorating the cleaning property. The extent of cleaning property deterioration was significant as the amount of the alkaline chemical contained in the nonionic surfactant-containing alkaline composition was increased.

The present inventors found that, by causing a compound (component C) as described below to be concomitantly present with a nonionic surfactant-containing alkaline composition that contains a nonionic surfactant (component A), water (component B) and at least one alkaline chemical (component D) selected from the group consisting of potassium hydroxide and sodium hydroxide and that contains the component A in an amount of 0.5 to 20 wt %, the pH at 25° C. is 12 or greater, the storage stability of a mixture of the nonionic surfactant-containing alkaline composition and the component C is good even under relatively high temperatures. The aforementioned component C is at least one compound selected from the group consisting of benzenesulfonic acid, toluenesulfonic acid, dimethylbenzenesulfonic acid, hydroxybenzenesulfonic acid and salts thereof, preferably at least one compound selected from the group consisting of benzenesulfonic acid, toluenesulfonic acid, dimethylbenzenesulfonic acid and salts thereof, and more preferably at least one compound selected from the group consisting of toluenesulfonic acid, dimethylbenzenesulfonic acid and salts thereof.

Although the mechanism of the storage stability enhancement is not clear, it is presumed that component C functions as a cloud point increasing agent for a mixture of the nonionic surfactant-containing alkaline composition and component C as shown by the results of the examples presented below.

Here, the term "cloud point (° C.)" refers to a temperature at which a nonionic surfactant-containing aqueous solution starts to become cloudy when the temperature of the aqueous solution is increased. When the movement of water molecules is increased as the temperature of the aqueous solution is increased, the hydrogen bond between the hydrophilic-group portions of the surfactant and the water molecules is broken, and the surfactant thus loses solubility, making the aqueous solution cloudy.

The cloud point of the alkali-type nonionic surfactant composition containing the components A to D (hereinafter sometimes simply referred to as a "surfactant composition") can be obtained as follows. (1) First, place 10 $cm^3$ of the surfactant composition into a 30 cc test tube. (2) Place the test tube in a warm bath and increase the temperature of the surfactant composition at a rate of 1° C./5 sec while manually stirring the surfactant composition using a glass stem thermometer. (3) Read the temperature of the surfactant composition when the surfactant composition remains cloudy even with stirring. (4) Remove the test tube out of the warm bath and gradually lower the temperature while stirring the surfactant composition with a stirring rod under a 25° C. atmosphere. (5) Read the temperature when the surfactant composition becomes transparent. (6) Repeat steps (2) to (5) twice, and the average of the temperatures read in step (3) is regarded as the cloud point.

<<Component A>>

Preferable examples of the nonionic surfactant (component A) contained in the surfactant composition from the viewpoint of enhancing cleaning property, effluent processability and environmental protection may be the nonionic surfactants represented by the following formula (1).

$$R^1\text{—O-(EO)}_m\text{(PO)}_n\text{—H} \quad (1)$$

wherein $R^1$ is an alkyl group having a carbon number of 8 to 18, alkenyl group having a carbon number of 8 to 18, acyl group having a carbon number of 8 to 18 or alkylphenyl group having a carbon number of 14 to 18. EO is an oxyethylene group and PO is an oxypropylene group. The characters m and n represent the average number of added moles of EO and PO, respectively. The character m represents a number from 1 to 20 and n represents a number from 0 to 20. The arrangement of EO and PO in $(EO)_m(PO)_n$ may be either block or random.

From the viewpoint of further enhancing the cleaning property of the surfactant composition, $R^1$ is more preferably an alkyl group having a carbon number of 8 to 14, alkenyl group having a carbon number of 8 to 14, acyl group having a carbon number of 8 to 14 or alkylphenyl group having a carbon number of 14 to 16, and more preferably an alkyl group having a carbon number of 8 to 14 from the viewpoint of simultaneously achieving enhancement in cleaning property, effluent processability and environmental protection.

$(EO)_m(PO)_n$ may be composed solely of an oxyethylene group, and it may be composed of an oxyethylene group and an oxypropylene group. When $(EO)_m(PO)_n$ is composed of an oxyethylene group and an oxypropylene group, the arrangement of EO and PO may be either block or random. When the arrangement of EO and PO is block, insofar as the average number of added moles are within the aforementioned ranges, the number of EO blocks and the number of PO blocks may each be one or may each be two or more. When the number of blocks composed of EO is two or more, how many times EO repeats in each block may be the same with each other or may be different. When the number of PO blocks is two or more, how many times PO repeats in each block may also be the same with each other or may be different.

When the arrangement of EO and PO is block or random, the molar ratio of EO to PO ($M_{EO}/M_{PO}$) being 9.5/0.5 to 5/5 is preferable for simultaneously achieving an ability to dissolve oil and an ability to be highly dissolved in water. Moreover, from the viewpoint of simultaneously achieving water solubility and low foamability, m is preferably 1 to 15, and more preferably 1 to 10. From the viewpoint of simultaneously achieving water solubility and low foamability, n is preferably 1 to 15 and more preferably 1 to 10, and m+n is preferably 1 to 30 and more preferably 1 to 20.

Specific examples of compounds represented by the formula (1) may be alcohols such as 2-ethylhexanol, octanol, decanol, isodecyl alcohol, tridecyl alcohol, lauryl alcohol, myristyl alcohol, stearyl alcohol, oleyl alcohol and the like; phenols such as octyl phenol, nonyl phenol, dodecyl phenol and the like; compounds in which an oxyethylene group and/or an oxypropylene group is added to these compounds; etc. The compounds represented by the formula (1) may be used singly or may be used as a mixture of two or more.

Those that are presented below may be preferably used as the nonionic surfactant of the component A. That is, $C_jH2_{j+1}$—O-$(EO)_p$—H, $C_jH_{2j+1}$—O-$(EO)_q(PO)_r$—H (provided that EO and PO are of block-addition), $C_jH_{2j+1}$—O—$(PO)_q(EO)_r$—H (provided that EO and PO are of block-addition), $C_jH_{2j+1}$—O-$(EO)_s(PO)_t(EO)_u$—H (provided that EO and PO are of block-addition), $C_jH_{2j+1}$—O-$(EO)_q(PO)_r$—H (provided that EO and PO are of random-addition) and the like may be preferably used, provided that in these formulae, EO is an oxyethylene group ($C_2H_4O$); PO is an oxypropylene group ($C_3H_6O$); j is a number from 8 to 18; p, q, r, s, t and u each represent the average number of added moles of EO or PO; p is a number from 1 to 20; q is a number from 1 to 20; r is a number from 1 to 20; s is a number from 1 to 10; t is a number from 1 to 10; and u is a number from 1 to 10.

The amount of nonionic surfactant contained in the surfactant composition may be, for balancing the sufficient cleaning property and the stability of the surfactant composition under strong alkalinity, 0.5 to 20 wt %, and from the viewpoint of simultaneously achieving good cleaning property and good rinsing property of the surfactant composition, it may be preferably 1 to 10 wt % and more preferably 2 to 5 wt %.

<<Component D>>

At least one alkaline chemical (component D) selected from the group consisting of potassium hydroxide and sodium hydroxide is contained in the surfactant composition, and from the viewpoint of enhancing the cleaning property of the surfactant composition, the alkaline chemical is preferably potassium hydroxide.

The amount of alkaline chemical contained in the surfactant composition is preferably 0.5 to 10 wt %, and from the viewpoint of enhancing the cleaning property, rinsing property and safety of the surfactant composition, it is preferably 1 to 5 wt %.

The pH of the surfactant composition of the present invention at 25° C. is 12 or greater, and from the viewpoint of enhancing the dispersibility of inorganic fine particles, it is preferably 12 to 14. When the hard surface of a substrate to be cleaned which is the target of cleaning is of a metal, the pH of the surfactant composition is more preferably 12 to 14, and when the hard surface is of glass, the pH of the surfactant composition is also more preferably 12 to 14. The aforementioned pH is the pH of the surfactant composition at 25° C., and it can be measured using a pH meter (DKK-TOA Corporation, HM-30G) and it is a value obtained after immersing the electrodes in the surfactant composition for 40 minutes.

<<Component B>>

Water (component B) contained in the surfactant composition is not particularly limited insofar as it can serve as a solvent, and examples may be ultrapure water, pure water, ion exchange water, distilled water and the like, and ultrapure water, pure water and ion exchange water are preferably usable, and ultrapure water is more preferably usable. Pure water and ultrapure water can be obtained by, for example, passing tap water through activated carbon, followed by ion exchange treatment, distillation, and as necessary, irradiation using a specific ultraviolet germicidal lamp, or passing through a filter. For example, in many cases, the electric conductivity of pure water at 25° C. is 1 μS/cm or less, and ultrapure water exhibits 0.1 μS/cm or less. The surfactant composition may further contain an aqueous solvent (for example, an alcohol such as ethanol) in addition to water as described above, but it is preferable that the solvent contained in the surfactant composition is composed solely of water.

<<Component C>>

The amount of the at least one compound (component C) selected from the group consisting of benzenesulfonic acid, toluenesulfonic acid, dimethylbenzenesulfonic acid, hydroxybenzenesulfonic acid and salts thereof contained in the surfactant composition is preferably 1 to 30 wt % and more preferably 2 to 20 wt % from the viewpoint of more sufficiently attaining the cloud point increasing effect; and further more preferably 2 to 15 wt % for attaining good rinsing property without excessively leaving the component C on the hard surface in regard to a solution diluted to an extent such that a sufficient cleaning property of the surfactant composition is ensured when the surfactant composition is diluted to be used.

An example of toluenesulfonic acid may be p-toluenesulfonic acid, and an example of dimethylbenzenesulfonic acid may be 2,4-dimethylbenzenesulfonic acid or the like. An example of hydroxybenzenesulfonic acid may be p-hydroxybenzenesulfonic acid or the like.

The component C is preferably water soluble and is preferably a salt. A counter ion to form a salt is not particularly limited, and it is preferable to use one or more alkali metal (such as sodium, potassium or the like) ions, ammonium ions, alkylammonium ions, etc. Sodium ions and/or potassium ions are more preferable, and sodium ions are even more preferable.

From the viewpoint of enhancing storage stability, the cloud point of the surfactant composition of the present invention is preferably 40° C. or higher, more preferably 50° C. or higher, still more preferably 60° C. or higher, even more preferably 65° C. higher, and further more preferably 70° C. or higher. The surfactant composition of the present invention may not always be stored at low temperatures, and for example, when produced in Japan, the surfactant composition may be transported domestically and then exported overseas by ship or the like and stored in an overseas warehouse. If an exported country is, for example, in Southeast Asia, the temperature of the surfactant composition could be 50° C. or higher, or 60° C. or higher. Even after the surfactant composition of the present invention experiences such a storage environment, any deterioration of cleaning property that may occur due to the property change of the surfactant composition is suppressed.

<<Optional Components>>

The surfactant composition may contain, in addition to the components A, B, C and D, a silicon-based antifoaming agent, a chelating agent (component E) such as EDTA or the like, a water soluble polymer (component F), an alcohol, a preservative, an antioxidant, etc.

The pH of the surfactant composition of the present invention is very high and it is desirable that such a pH is ensured by the use of an alkaline chemical of an appropriate amount. Therefore, when components, other than the component E and component F, that may exhibit a buffering action are contained in the surfactant composition of the present invention, it is preferable that the components are contained in amounts such that the components do not exhibit any pH buffering action, and it is more preferable that no buffering agents are contained except the component E and component F. That is, it is preferable that the components that are contained in the surfactant composition of the present invention and that may exhibit a buffering action are the component E and component F only.

The storage stability of the surfactant composition of the present invention at high temperatures is enhanced by containing the component C, and for securing good rinsing property, it is preferable that, for example, glycerol, which is known as a stabilizer contained in a household detergent or the like and exhibits a strong affinity with a metal, is not excessively contained in the surfactant composition of the present invention, and it is more preferable that glycerol is not contained. It is preferable that the component contained in the surfactant composition of the present invention for enhancing storage stability is the component C only.

The storage stability of the surfactant composition of the present invention at high temperatures is enhanced by containing a lower alkylbenzenesulfonic acid and/or a salt thereof as the component C, and when a higher alkylbenzenesulfonic acid such as dodecylbenzenesulfonic acid or a salt thereof, which has a strong ability to function as a surfactant is contained in the surfactant composition of the present invention, the amount of the component contained is preferably such that the effect to enhance storage stability brought about by the component C is not impaired, and it is more preferable that neither a higher alkylbenzene sulfonic acid nor a salt thereof as mentioned above is not contained in the surfactant composition of the present invention.

<<Component E>>

It is preferable from the viewpoint of enhancing the cleaning property against metal ions that a chelating agent is contained in the surfactant composition. Examples of chelating agents may be aldonic acids such as gluconic acid, glucoheptonic acid and the like; aminocarboxylic acids such as ethylenediaminetetraacetic acid and the like; hydroxycarboxylic acids such as citric acid, malic acid and the like; phosphonic acids such as amino trimethylene phosphonic acid, hydroxyethylidenediphosphonic acid and the like; and alkali metal salts, lower amine salts, ammonium salts and alkanol ammonium salts thereof. Sodium gluconate, sodium glucoheptonate, sodium ethylenediaminetetraacetate, sodium citrate and sodium hydroxyethylidenediphosphonate may be more preferable. These chelating agents may be used singly or as a mixture of two or more.

The amount of chelating agent contained is, from the viewpoint of enhancing the cleaning property against metal ions, preferably 1 to 10 wt % and more preferably 1 to 5 wt %.

<<Component F>>

A water soluble polymer may be contained in the surfactant composition from the viewpoint of enhancing the dispersibility of inorganic fine particles. Carboxylic acid-based copolymers may be preferable as water soluble polymers.

Examples of carboxylic acid-based copolymers may be water soluble polymers having a constitutional unit (A1) derived from at least one compound selected from the group consisting of acrylic acid, methacrylic acid and maleic acid, preferably derived from an acrylic acid-based compound, and more preferably derived from acrylic acid. In a water soluble polymer, the constitutional unit (A1) is preferably contained in an amount of 20 mol % or greater of the entire constitutional units, and from the viewpoint of simultaneously achieving good cleaning property and good rinsing property of the surfactant composition, the constitutional unit (A1) is contained in an amount of preferably 80 mol % or greater and more preferably 90 mol % or greater.

Specific examples of water soluble polymers may be acryl acid copolymers, methacrylic acid copolymers, maleic acid copolymers, acrylic acid/methacrylic acid copolymers, acrylic acid/maleic acid copolymers, methacrylic acid/methacrylic acid dimethylamino ester copolymers, methacrylic acid/acrylic acid methyl ester copolymers, etc.

When a water soluble polymer has a constitutional unit (A2) derived from 2-acrylamide-2-methylpropanesulfonic acid, it is preferable from the viewpoint of enhancing the dispersibility of inorganic fine particles that the sum of the mol % of the constitutional unit A1 and the mol % of the constitutional unit A2 derived from 2-acrylamide-2-methylpropanesulfonic acid is 90 mol % or greater of the entire constitutional units of the water soluble polymer.

The molar ratio of the constitutional unit A1 to the constitutional unit A2 ($M_{A1}/M_{A2}$) is, from the viewpoint of enhancing the dispersibility of inorganic fine particles, preferably 20/80 to 98/2, more preferably 50/50 to 95/5, and even more preferably 91/9 to 95/5.

A water soluble polymer having a molar ratio ($M_{A1}/M_{A2}$) of 91/9 to 95/5 (component f) is contained in the component F in an amount of preferably 90 wt % or greater, and more preferably 100 wt %.

(Component f)

The component f is a copolymer that contains the constitutional unit A1 derived from at least one compound selected from the group consisting of acrylic acid, methacrylic acid and maleic acid preferably in an amount of 20 mol % or greater of the entire constitutional units, and contains the constitutional unit A1 and the constitutional unit A2 derived from 2-acrylamide-2-methylpropanesulfonic acid in a molar ratio ($M_{A1}/M_{A2}$) of 91/9 to 95/5. When this copolymer is contained in the surfactant composition, an advantageous effect, i.e., a substrate can be cleaned with the surfactant composition being in a state of having a good dispersibility that is brought by an increase in zeta potential while the good rinsing property of the surfactant composition is maintained, may be attained.

The total amount of constitutional unit A1 and constitutional unit A2 relative to the entire constitutional units of the component f is preferably 80 mol % or greater and more preferably 90 mol % or greater from the view point of simultaneously achieving enhancement of the water solubility of the copolymeric component f and prevention of fine particle agglomeration and deterioration of fine particle removability that may be caused by impaired water solubility of the component f.

The copolymeric component f containing A1 and A2 in such a proportion (molar ratio) can give an appropriate electric charge to fine particles and is therefore considered to be effective to prevent fine particle agglomeration.

From the viewpoint of preventing the deterioration of fine particle removability that may be caused by the occurrence of agglomeration and obtaining sufficient fine particle removability, it is preferable that the weight-average molecular weight of the copolymeric compound component F is 500 to 150000, more preferably 1000 to 100000, and even more preferably 1000 to 50000. The weight-average molecular weight of the copolymeric component F can be determined by, for example, gel permeation chromatography (GPC) performed under the following conditions.

(GPC Conditions)

Column: G4000PWXL+G2500PWXL (manufactured by Tosoh Corporation)

Eluate: 0.2M Phosphoric acid buffer/$CH_3CN$=9/1 (volume ratio)

Flow rate: 1.0 mL/min

Column temperature: 40° C.

Detection: RI

Sample size: 0.2 mg/mL

Reference material: Polyethylene glycol equivalent

The component F may be a salt of an aforementioned copolymer. Such salts are not particularly limited, and specifically, alkali metal salts such as sodium salts, potassium salts and the like; and salts with nitrogen-containing compounds having molecular weight of 300 or less are preferable. Examples of nitrogen-containing compounds having molecular weight of 300 or less may be those in which ethyleneoxide, propylene oxide or the like is added to ammonia, alkyl amine or polyalkyl polyamine, i.e., amino alcohols such as monoethanolamine, diethanolamine, triethanolamine, methylethanolamine, monopropanolamine, dipropanolamine, tripropanolamine, methylpropanolamine, monobutanolamine, aminoethylethanolamine and the like; quarternary ammonium salts such as tetramethylammonium hydroxide, choline and the like; etc.

From the viewpoint of demonstrating sufficient fine particle removability, good dispersion stability and good effluent processability, the amount of water soluble polymer contained in the surfactant composition is preferably 0.001 to 30 wt %, more preferably 0.01 to 20 wt %, still more preferably 0.1 to 10 wt %, and even more preferably 1 to 10 wt %.

(Hard-Surface Cleaning Agent)

The hard-surface cleaning agent of the present invention consists of the surfactant composition of the present invention. Therefore, a preferable mode of each component of the hard-surface cleaning agent of the present invention is the same as that of the surfactant composition of the present invention. The hard-surface cleaning agent of the present invention may be used as it is or used after dilution as necessary. In consideration of cleaning efficiency, the extent of dilution is preferably 10 to 500-fold, more preferably 20 to 200-fold, and even more preferably 50 to 100-fold. Water for dilution may be the same as that for use as the component B contained in the surfactant composition.

The hard-surface cleaning agent of the present invention may be contained as one component in a cleaning agent composition that contains components other than those that constitute the hard-surface cleaning agent of the present invention. Such use of the hard-surface cleaning agent of the present invention as one component is also encompassed within an embodiment of the hard-surface cleaning agent of the present invention.

(Cleaning Method)

The method for cleaning a hard surface of the present invention includes the step of cleaning a hard surface that is a target of cleaning using the hard-surface cleaning agent described above. In the aforementioned step, the hard-surface cleaning agent is supplied to the hard surface by (a) immersing the cleaning target in the hard-surface cleaning agent and/or (b) injecting the hard-surface cleaning agent.

In the aforementioned procedure (a), conditions of immersing the cleaning target in the hard-surface cleaning agent are not particularly limited, and for example, the temperature of the hard-surface cleaning agent is preferably 20 to 100° C. from the viewpoint of safety and operability, and the immersion time is preferably 10 seconds to 30 minutes from the viewpoint of the cleaning property of the hard-surface cleaning agent and production efficiency. In addition, it is preferable, from the viewpoint of enhancing fine particle removability and fine particle dispersibility, to apply ultrasonic vibrations to the hard-surface cleaning agent. The ultrasonic frequency is preferably 20 to 2000 kHz, more preferably 100 to 2000 kHz, and even more preferably 1000 to 2000 kHz.

In the aforementioned procedure (b), it is preferable, from the viewpoint of promoting fine particle cleaning property and oil dissolvability, to clean a cleaning target hard surface by bringing the hard-surface cleaning agent into contact with the hard surface by injecting the hard-surface cleaning agent to which ultrasonic vibrations are applied, or to clean by injecting the hard-surface cleaning agent onto the hard surface and then by rubbing with a cleaning brush the hard surface provided with the hard-surface cleaning agent. It is further preferable to clean by supplying by injection the hard-surface cleaning agent to which ultrasonic vibrations are applied to the hard surface and rubbing with a cleaning brush the hard surface provided with the hard-surface cleaning agent.

A known means such as a spray nozzle or the like can be used as a means to supply the hard-surface cleaning agent to a hard surface. Moreover, a cleaning brush is not particularly limited, and for example, known brushes such as a nylon brush, a PVA sponge brush and the like can be used. It is sufficient that the ultrasonic frequency is represented by the same values as those preferably selected in the procedure (a) described above.

The method for cleaning a hard surface of the present invention may include, in addition to the above-described procedure (a) and/or the above-described procedure (b), one or more steps in which known cleaning such as swinging cleaning, cleaning using the rotation of a spinner or the like, paddle cleaning, etc., is used.

Examples of cleaning targets to which the method of cleaning a hard surface of the present invention is suitably applied may be hard surfaces of recording medium substrates, photomask substrates (glass substrates), flat-panel display substrates or the like that contain metallic materials or glass materials.

Examples of recording medium substrates may be circular substrates on which an Ni—P layer is formed on a metal substrate such as an aluminum substrate or the like, circular substrates composed of chemically strengthened glass, and the like. Recording media can be obtained by forming on these recording medium substrates a magnetic layer that has a magnetic recording area and contains a metallic thin film by spattering or a like method. Examples of metallic materials that may constitute the aforementioned metallic thin film include cobalt alloys that are alloys of chromium, tantalum or platinum with cobalt, and like alloys.

In the process of producing a recording medium substrate, in order to enhance the surface smoothness of both principal surfaces of the recording medium substrate, a polishing step in which the surfaces of the recording medium substrate (polishing target substrate) is polished using a polishing agent containing, for example, inorganic fine particles of alumina or silica and a solvent (i.e., water) for dispersing the inorganic fine particles is included. Dirt derived from the polishing agent (inorganic fine particles, organic substances, etc.), metal ions derived from facilities such as apparatuses adhere to both principal surfaces of the recording medium substrate that has undergone the polishing step. The hard-surface cleaning agent of the present invention can efficiently clean such dirt.

Figure 3:
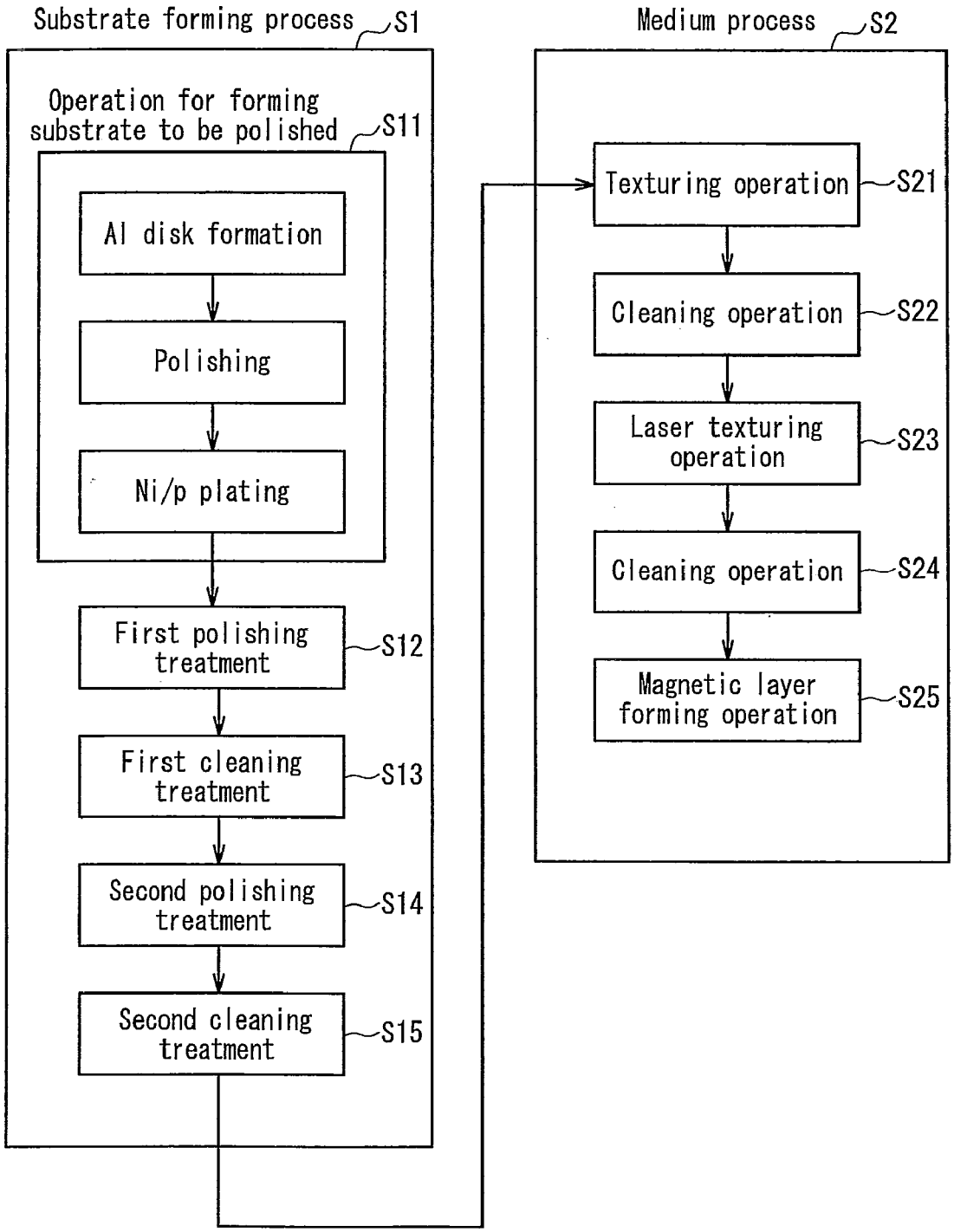
FIG. 3 is a flow chart showing an example of the method for producing a recording medium of the present invention.

FIG. 3 shows an example of a method for producing a recording medium using the recording medium substrate described above. A substrate forming process S1 and a medium process S2 are included in the process for producing a recording medium. In the substrate forming process S1, first, in an operation S11 forming substrate to be polished, a substrate to be polished in which an aluminum substrate is entirely covered with Ni—P is prepared by performing Ni—P plating on an aluminum substrate. Next, a recording medium substrate is obtained by performing on this substrate to be polished at least polishing treatment (S12, S14) and cleaning treatment (S13, S15) several times in this order.

When the recording medium is a horizontal magnetic recording medium, in the aforementioned medium process, small unevenness are initially created on both principal surfaces of a recording medium substrate by polishing using a diamond abrasive or the like (texturing operation S21), cleaning is performed (cleaning operation S22), and then a magnetic layer is formed on each of the aforementioned principal surface sides (magnetic layer forming operation S25).

When the recording medium is a perpendicular magnetic recording medium, in the aforementioned medium process, cleaning of a recording medium substrate is performed (cleaning operation S22) and then a magnetic layer is formed on each of the aforementioned principal surface sides (magnetic layer forming operation S25), but the aforementioned texturing operation 21 may be performed as necessary before the cleaning operation, and after the cleaning operation 22, an operation to form a caldera-like projections on both principal surfaces of the recording medium substrate by laser irradiation (laser texturing operation S23) may be performed (see JP 10(1998)-199047 A, JP 2007-95238 A, etc.).

It is preferable to use the hard-surface cleaning agent of the present invention when the final run of the aforementioned cleaning treatment that is performed several times is carried out.

The aforementioned magnetic layer may be formed only on one principal surface side of the two principal surfaces of the recording medium substrate.

Similarly, in the process of producing photomask and flat-panel display substrates also, contamination by inorganic fine particles, organic substances or the like occurs, and therefore a cleaning agent that sufficiently removes them is needed.

A photomask is a template that defines a circuit pattern for use in a lithography operation when forming a circuit pattern of a semiconductor device, and is composed of a glass substrate and a shading metal pattern layer formed on a surface thereof. Materials for a shading metal pattern layer may be chromium, molybdenum and the like, and materials for a glass substrate may be quartz glass and the like.

A flat-panel display substrate refers to a substrate that is composed of a glass substrate and an electrode layer formed on a surface thereof and that is for use as a panel display material in the process of producing liquid crystal televisions and plasma televisions. Materials for an electrode layer may be transparent electrode thin films (ITO films: indium tin oxide films) and the like, and materials for a glass substrate may be alkali-free glass and the like.

Figure 4:
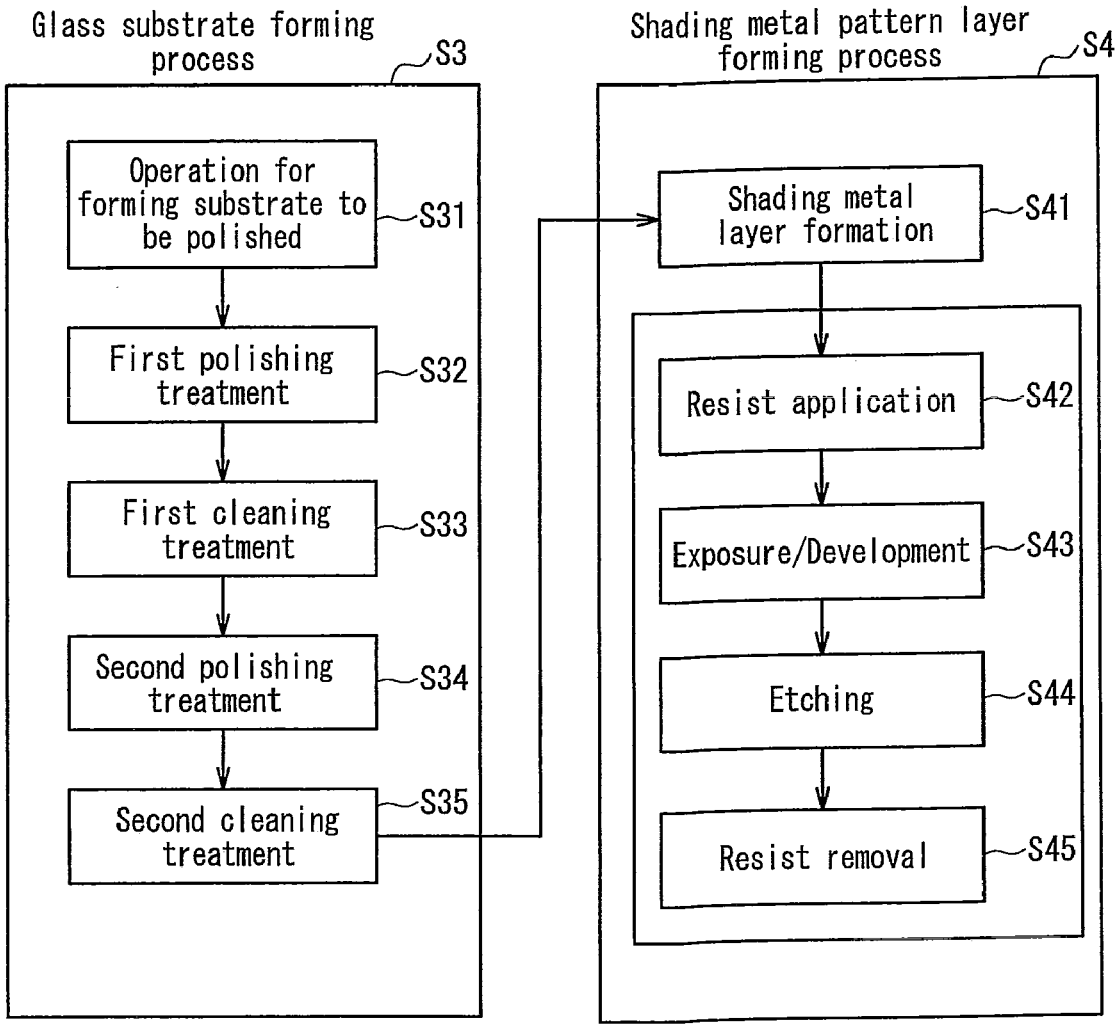
FIG. 4 is a flow chart showing an example of the method for producing a photomask of the present invention.

FIG. 4 shows an example of a method for producing a photomask.

As shown in FIG. 4, a glass substrate forming process S3 and a shading metal pattern layer forming process S4 are included in the method for producing a photomask. In the glass substrate forming process S3, a glass substrate is formed by performing polishing treatment (S32, S34) and cleaning treatment (S33, S35) several times in this order on a substrate to be polished (base material for a glass substrate) that has been formed in a to-be-polished substrate forming operation S31. Next, a shading metal layer is formed on the glass substrate by spattering or a like method (S41), and then the shading metal layer is selectively etched using a lithography technique to form a shading metal pattern layer on the glass substrate.

Specifically, a photoresist (photosensitive resin) is initially applied to a shading metal layer (S42). Next, ultraviolet rays or the like are irradiated on the photoresist through a mask for photomask formation to transfer the mask pattern onto the photoresist, the photoresist is then developed, and the exposed portions of the photoresist are removed (S43). Next, the portions of the shading metal layer that are uncovered by the removal of the portions of the photoresist are removed by etching (S44) to form a shading metal pattern layer. Finally, the aforementioned photoresist is removed (S45).

In forming a glass substrate, it is preferable to use the hard-surface cleaning agent of the present invention when the final run of the aforementioned cleaning treatment that is performed several times is carried out.

Figure 5:
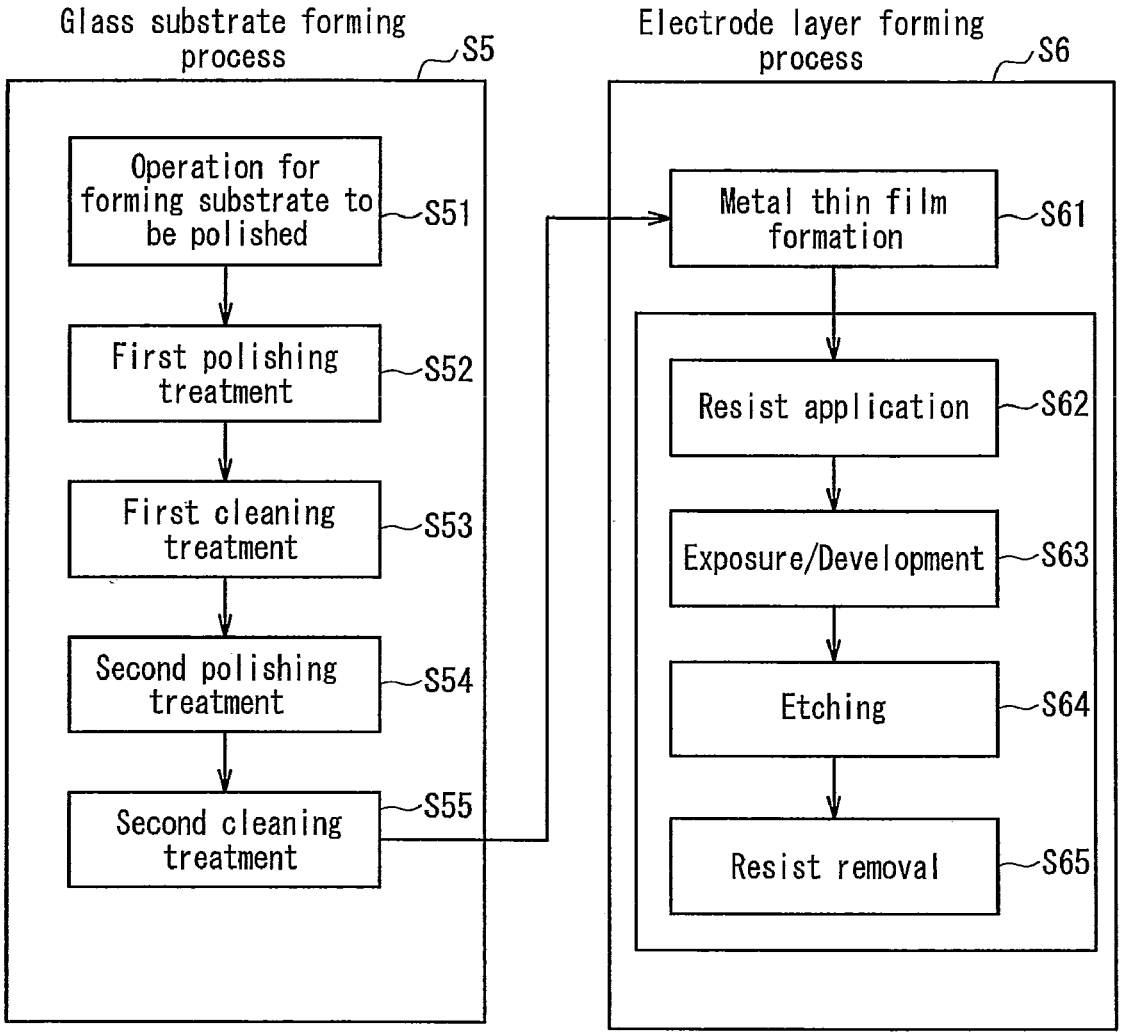
FIG. 5 is a flow chart showing an example of the method for producing a flat-panel display substrate of the present invention.

FIG. 5 shows an example of a method for producing a fiat-panel display substrate.

As shown in FIG. 5, a glass substrate forming process S5 and an electrode layer forming process S6 are included in the method for producing a flat-panel display substrate. In the glass substrate forming process S5, a glass substrate is formed by performing polishing treatment (S52, S54) and cleaning treatment (S53, S55) several times in this order on a substrate to be polished (base material for a glass substrate) that has been formed in an operation S51 forming substrate to be polished. Next, a metal thin film is formed on the glass substrate by spattering or a like method (S61), and then the metal thin film is selectively etched using a lithography technique to form an electrode layer on the glass substrate (S62 to S65).

Specifically, a photoresist (photosensitive resin) is initially applied to a shading metal film (S62). Next, ultraviolet rays or the like are irradiated on the photoresist through a mask for photomask formation to transfer the mask pattern onto the photoresist, the photoresist is then developed, and the exposed portions of the photoresist are removed (S63). Next, the portions of the metal thin film that are uncovered by the removal of the portions of the photoresist are removed by etching (S64) to form an electrode layer. Finally, the aforementioned photoresist is removed (S65).

In the production methods shown in FIG. 3 to FIG. 5, the polishing treatment and the cleaning treatment are each performed twice, but how many times the polishing treatment and the cleaning treatment are performed is not particularly limited insofar as each of the treatments is performed at least twice. The hard-surface cleaning agent of the present invention may be used not only when the final run of the cleaning treatment that is performed several times is carried out, but also when other runs of the cleaning treatment that is performed several times may be carried out.

In the method for cleaning a hard surface of the present invention, substrates may be cleaned one substrate at a time, or a plurality of substrates to be cleaned may be cleaned at once. Moreover, one or more cleaning tanks to be used in cleaning may be one or more.

EXAMPLES

1. Preparation of Surfactant Compositions and Hard-Surface Cleaning Agents

The surfactant compositions of Examples 1 to 13 and Comparative Examples 1 to 7 were obtained by blending and mixing the components so as to attain the make-ups presented in Table 1 and Table 2. In the preparation of the surfactant compositions of Examples 1 to 10 and Comparative Examples 1 to 5 and 7, a commercially available aqueous potassium hydroxide solution (KOH concentration: 48 wt %) was used. In the preparation of the surfactant compositions of Examples 11 to 13, a commercially available aqueous sodium hydroxide solution (NaOH concentration: 48 wt %) was used. In the preparation of the surfactant composition of Comparative Example 6, commercially available monoethanolamine was used.

Cleaning property tests as described below were carried out using the resulting surfactant compositions as hard-surface cleaning agents. The aforementioned hard-surface cleaning agents after storage under a 60° C. atmosphere for one month were diluted 100-fold with water, and cleaning property tests as described below were carried out using those diluted solutions.

The numerical values attached to the characters C of the components A in Table 1 and Table 2 indicate the number of carbon atoms contained in the hydrocarbons. $C_{(12-14)}$—O-$(EO)_5(PO)_{1.5}(EO)_5$—H is a mixture of $C_{12}$—O-$(EO)_5(PO)_{1.5}(EO)_5$—H and $C_{14}$—O-$(EO)_5(PO)_{1.5}(EO)_5$—H.

2. Cleaning Property Test with Substrate to be Cleaned

By performing polishing using a generally used polishing slurry, a substrate to be cleaned that was soiled with fine particles of an abrasive derived from the polishing slurry, polishing dust derived from the substrate material and the like was prepared, and the cleaning property of the diluted solutions of the hard-surface cleaning agents against the fine particles was evaluated using this substrate.

2-1. Preparation of Substrates to be Cleaned (Substrate A to be Cleaned)

A substrate obtained by performing additional polishing under the following conditions (polishing conditions A) on both principal surfaces of a Ni—P plated substrate (outer diameter: 95 mmϕ, inner diameter: 25 mmϕ, thickness: 1.27 mm, surface roughness (Ra): 1 nm) that had been obtained by performing preliminary rough polishing using a polishing agent slurry containing an alumina abrasive was used as substrate A to be cleaned.

(Polishing Conditions A)

Polishing machine: Double-side 9B polisher (manufactured by SpeedFam Co., Ltd.)

Polishing pad: Suede type (thickness: 0.9 mm, average pore diameter: 30 μm, manufactured by Fujibo Co., Ltd.)

Polishing liquid: Colloidal silica slurry (Product No.: Memolead 2P-2000, manufactured by Kao Corporation)

Main polishing: load: 100 g/cm$^2$, time: 300 seconds, flow rate of polishing slurry: 100 mL/min Water rinse: load: 30 g/cm$^2$, time 20 seconds, flow rate of rinsing water: about 2 L/min (Substrate B to be Cleaned)

A substrate obtained by performing additional polishing under the following conditions (polishing conditions B) on an aluminosilicate glass substrate (outer diameter: 65 minϕ, inner diameter: 20 minϕ, thickness: 0.635 mm) that had been obtained by performing preliminary two-stage polishing using a polishing agent slurry containing a cerium oxide abrasive was used as substrate B to be cleaned.

(Polishing Conditions B)

Polishing machine: Double-side 9B polisher (manufactured by SpeedFam Co., Ltd.)

Polishing pad: Suede type (thickness: 0.9 mm, average pore diameter: 30 μm, manufactured by Fujibo Co., Ltd.)

Polishing liquid: Colloidal silica slurry (Product No.: Memolead GP2-317, manufactured by Kao Corporation)

Preliminary polishing: load: 60 g/cm$^2$, time 60 seconds, flow rate of polishing slurry: 100 mL/min Main polishing: load: 100 g/cm$^2$, time: 900 seconds, flow rate of polishing slurry: 100 mL/min Water rinse: load: 30 g/cm$^2$, time: 300 seconds, flow rate of rinsing water: about 2 L/min 2-2. Cleaning The substrate A to be cleaned and the substrate B to be cleaned were both cleaned using a cleaning device (three-stage type: roll brushes (first stage), roll brushes (second stage) and ultrasonic shower (third stage)) under the following conditions.

(1) Cleaning: The substrates to be cleaned introduced into the cleaning device were placed in the transfer waiting area, one piece of the substrates to be cleaned was then transferred to a place in the cleaning device where roll brushes were installed (first stage), revolving roll brushes were pressed against both principal surfaces of the substrate to be cleaned, and cleaning was performed for 20 seconds by injecting a diluted solution of a hard-surface cleaning agent onto both principal surfaces of the substrate to be cleaned. The amount of diluted solution of a hard-surface cleaning agent supplied was 70 g/20 sec.

(2) Rinsing: The substrate after cleaning by the diluted solution of a hard-surface cleaning agent was transferred to a place in the cleaning device where roll brushes were installed (second stage), revolving roll brushes were then pressed against both principal surfaces of the cleaned substrate in the same manner as in the cleaning (1) described above, and rinsing was performed for 20 seconds by injecting normal-temperature ultrapure water onto both principal surfaces of the cleaned substrate. The cleaned substrate was then transferred to a place where an ultrasonic shower was installed (third stage), and rinsing was performed for 20 seconds by injecting normal-temperature ultrapure water provided with ultrasonic waves of 950 kHz onto both principal surfaces of the cleaned substrate. The amount of normal-temperature ultrapure water provided with ultrasonic waves of 950 kHz supplied was 300 g/20 sec.

(3) Drying: the rinsed substrate held on the spin chuck was subjected to fluid removal drying by rapid spinning (at 3000 rpm) for 1 minute.

2-3. Evaluation of Cleaning Property Against Fine Particles

The cleaning property against fine particles on the surface of the substrates that had undergone (1) through (3) was evaluated according to the following method. The results are shown in Table 1 and Table 2.

The dried substrates were observed with a scanning electron microscope at 1000-fold magnification (visual field range: about 100 μm per side), and the number of fine particles remaining on the substrate surfaces observed within the visual field was counted. For 5 substrates, this observation was carried out at 10 locations at random on each principal surface of a substrate, i.e., 100 locations in total (10 locations×2×5 substrates). Based on the total number of fine particles at the 100 observed locations and according to the following evaluation criterion, the cleaning property against fine particle was evaluated on a 4-point scale.

<Evaluation Criterion for Cleaning Property Against Fine Particles>

◎: The total number of fine particles was 0.

○: The total number of fine particles was 1 or 2.

Δ: The total number of fine particles was 3 to 5.

x: The total number of fine particles was 6 or more.

Acceptable products have a cleaning property against fine particles of either ○ or ◎.

As can be understood from the results shown in Table 1 and Table 2, the diluted solutions of hard-surface cleaning agents prepared using the surfactant compositions of the present invention have excellent cleaning property against fine particles. Moreover, the cloud points of the surfactant compositions of Examples 4 to 10 and 13 were all 65° C. or higher. The term "cloudy" in Table 2 means that the surfactant compositions were in the state of being turbid and opaque to such an extent that nothing beyond the transparent containers filled with the surfactant compositions could be seen through the containers. The term "slightly cloudy" means that although the surfactant composition was in the state of being turbid, things beyond the transparent plastic container filled with the surfactant composition could be seen through the container. The cloud points of the compositions of Comparative Examples 1, 3 and 4, which were slightly cloudy or cloudy at 25° C., were not measured.

TABLE 1

| Component | | Example 1 | 2 | 3 | 4 | 5 | 6 | 7 |
|---|---|---|---|---|---|---|---|---|
| | | Composition (wt %) | | | | | | |
| A | Emulgen 108 $C_{12}$—O-$(EO)_8$—H | | | | 2.0 | | | |
| | Emulgen LS-110 Linear $C_{12-14}$—O-$(EO)_5(PO)_{1.5}(EO)_5$—H | 2.0 | 2.0 | 2.0 | | 2.0 | 2.0 | 2.0 |
| B | Water | 93.6 | 91.2 | 83.2 | 78.2 | 78.2 | 78.2 | 83.2 |
| C | Sodium benzenesulfonate | | | 5.0 | | 10.0 | | |
| | Sodium p-toluenesulfonate | 2.0 | 2.0 | | 10.0 | | 10.0 | |
| | Sodium 2,4-dimethylbenzenesulfonate | | | | | | | 5.0 |
| | Sodium p-hydroxybenzenesulfonate | | | | | | | |
| E | 1-hydroxyethylidene-1,1-diphosphonic acid | | | 4.2 | 4.2 | 4.2 | 4.2 | 4.2 |
| F | Sodium salt of acrylic acid/ 2-acrylamide-2-methylpropanesulfonic acid copolymeric compound (92 mol %/8 mol %) (Weight-average molecular weight: 12000 (in terms of polyethylene glycol)) | | | 0.8 | 0.8 | 0.8 | 0.8 | 0.8 |
| D | NaOH | | | | | | | |
| | KOH | 2.4 | 4.8 | 4.8 | 4.8 | 4.8 | 4.8 | 4.8 |
| pH of surfactant composition | 25° C. | 13.7 | 13.9 | 13.5 | 13.5 | 13.5 | 13.5 | 13.5 |
| Appearance of surfactant omposition | Condition at 25° C. | Clear | Clear | Clear | Clear | Clear | Clear | Clear |
| Cloud point of surfactant composition | *Fluid temperature up to 90° C. due to measurement in warm bath | 63° C. | 51° C. | 53° C. | 85° C. | 73° C. | 88° C. | 75° C. |
| Cleaning property of diluted solution of hard-surface cleaning agent | Cleaning property for NiP substrate (Substrate A to be cleaned) | ○ | ○ | ○ | ○ | ○ | ◎ | ◎ |
| | Cleaning property for glass substrate (Substrate B to be cleaned) | ○ | ○ | ○ | ◎ | ◎ | ◎ | ◎ |

| Component | | Example 8 | 9 | 10 | 11 | 12 | 13 |
|---|---|---|---|---|---|---|---|
| | | Composition (wt %) | | | | | |
| A | Emulgen 108 $C_{12}$—O-$(EO)_8$—H | | | | | | |
| | Emulgen LS-110 Linear $C_{12-14}$—O-$(EO)_5(PO)_{1.5}(EO)_5$—H | 2.0 | 2.0 | 2.0 | 2.0 | 2.0 | 2.0 |

TABLE 1-continued

| | | | | | | | |
|---|---|---|---|---|---|---|---|
| B | Water | 78.2 | 68.2 | 78.1 | 93.6 | 91.2 | 78.2 |
| C | Sodium benzenesulfonate | | | | | | |
| | Sodium p-toluenesulfonate | | | 10.0 | 2.0 | 2.0 | 10.0 |
| | Sodium 2,4-dimethylbenzenesulfonate | 10.0 | 20.0 | | | | |
| | Sodium p-hydroxybenzenesulfonate | | | | | | |
| E | 1-hydroxyethylidene-1,1-diphosphonic acid | 4.2 | 4.2 | 4.3 | | | 4.2 |
| F | Sodium salt of acrylic acid/ 2-acrylamide-2-methylpropanesulfonic acid copolymeric compound (92 mol %/8 mol %) (Weight-average molecular weight: 12000 (in terms of polyethylene glycol)) | 0.8 | 0.8 | 0.8 | | | 0.8 |
| D | NaOH | | | | 2.4 | 4.8 | 4.8 |
| | KOH | 4.8 | 4.8 | 4.8 | | | |
| pH of surfactant composition | 25° C. | 13.5 | 13.5 | 12.5 | 13.4 | 13.6 | 13.4 |
| Appearance of surfactant omposition | Condition at 25° C. | Clear | Clear | Clear | Clear | Clear | Clear |
| Cloud point of surfactant composition | *Fluid temperature up to 90° C. due to measurement in warm bath | 90° C.< | 90° C.< | 90° C.< | 59° C. | 43° C. | 85° C. |
| Cleaning property of diluted solution of hard-surface cleaning agent | Cleaning property for NiP substrate (Substrate A to be cleaned) | ◎ | ○ | ◎ | ○ | ○ | ◎ |
| | Cleaning property for glass substrate (Substrate B to be cleaned) | ◎ | ○ | ◎ | ○ | ○ | ◎ |

TABLE 2

| | | Comparative Example | | | | | | |
|---|---|---|---|---|---|---|---|---|
| | | 1 | 2 | 3 | 4 | 5 | 6 | 7 |
| Component | | Composition (wt %) | | | | | | |
| A* | Emulgen 108 $C_{12}$—O-$(EO)_8$—H | 2.0 | | | | | | |
| | Emulgen LS-110 Linear $C_{12-14}$—O-$(EO)_5(PO)_{1.5}(EO)_5$—H | | 2.0 | 2.0 | 2.0 | 2.0 | 2.0 | 2.0 |
| B* | Water | 88.2 | 88.2 | 78.2 | 78.2 | 78.4 | 90.3 | 78.2 |
| C* | Sodium octylbenzenesulfonate | | | 10.0 | | | | |
| | Sodium dodecylbenzenesulfonate | | | | 10.0 | | | |
| | Sodium p-toluenesulfonate | | | | | 10.0 | | |
| | Sodium 2,4-dimethylbenzenesulfonate | | | | | | 2.0 | |
| | Sodium p-hydroxybenzenesulfonate | | | | | | | 10.0 |
| E* | 1-hydroxyethylidene-1,1-diphosphonic acid | 4.2 | 4.2 | 4.2 | 4.2 | 4.2 | 1.2 | 4.2 |
| F* | Sodium salt of acrylic acid/ 2-acrylamide-2-methylpropanesulfonic acid copolymeric compound (92 mol %/8 mol %) (Weight-average molecular weight: 12000 (in terms of polyethylene glycol)) | 0.8 | 0.8 | 0.8 | 0.8 | 0.8 | 2.0 | 0.8 |
| D* | Monoethanolamine | | | | | | 2.5 | |
| | KOH | 4.8 | 4.8 | 4.8 | 4.8 | 4.6 | | 4.8 |
| pH of surfactant composition | 25° C. | 13.5 | 13.6 | 13.5 | 13.5 | 11.0 | 10.0 | 10.2 |
| Appearance of surfactant composition | Condition at 25° C. | Cloudy | Clear | Slightly cloudy | Cloudy | Clear | Clear | Clear |
| Cloud point of surfactant composition | *Fluid temperature up to 90° C. due to measurement in warm bath | — | 40° C. | — | — | 87° C. | 74° C. | 46° C. |
| Cleaning property of diluted solution of hard-surface cleaning agent | Cleaning property for NiP substrate | Δ | Δ | X | — | Δ | Δ | Δ |
| | Cleaning property for glass substrate | Δ | Δ | Δ | — | Δ | X | X |

*For convenience for comparison with Examples, the components of the compositions of Comparative Examples are classified into Components A to F.

2-4. Evaluation of Rinsing Property

Figure 2:
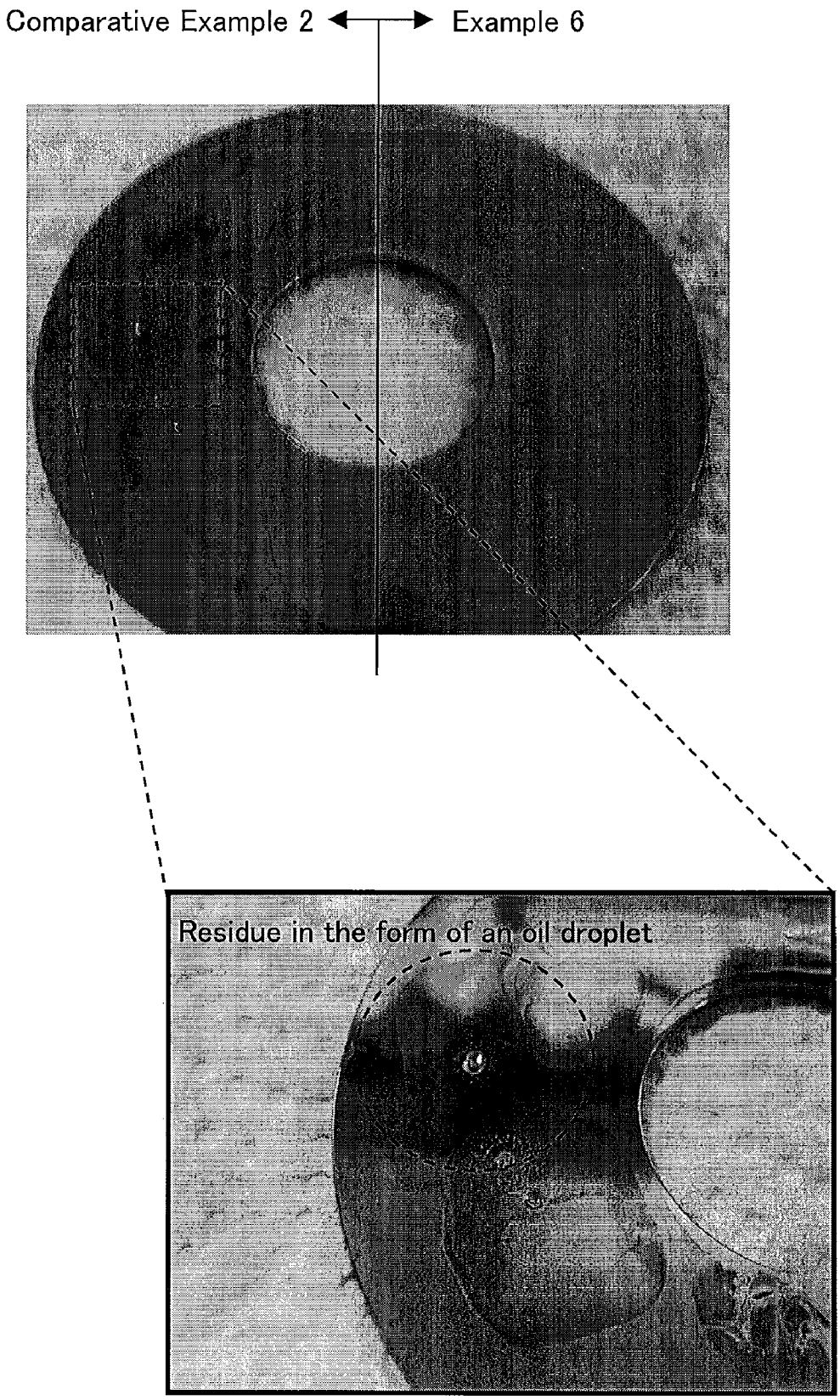
FIG. 2 is a photograph showing the appearance immediately after rinsing the substrate surface shown in FIG. 1.

FIG. 1 shows the appearance of a surface of the Substrate A to be cleaned after the left half of the substrate was given three droplets of a hard-surface cleaning agent consisting of the surfactant composition of Comparative Example 2 and the right half of the substrate was given three droplets of a hard-surface cleaning agent consisting of the surfactant composition of Example 6 and the substrate was dried by being left to stand at room temperature, and FIG. 2 shows the appearance immediately after rinsing the substrate shown in FIG. 1 under the conditions described below.

(Rinsing) About 500 ml each of pure water was poured onto the right half of the substrate and the left half of the substrate. In this instance, care was taken not to let the hard-surface cleaning agent consisting of the surfactant composition of Comparative Example 2 dripped over the left half of the substrate move into the right half of the substrate and not to let the hard-surface cleaning agent consisting of the surfactant composition of Example 6 dripped over the right half of the substrate move into the left half of the substrate.

As can be understood from FIG. 2, when the surfactant composition of Example 6 having a higher cloud point was used, the hard-surface cleaning agent was favorably removed by rinsing from the surface of the cleaned substrate, and it was thus demonstrated that droplets are unlikely to remain after rinsing. That is, it was demonstrated that a surfactant composition having a high cloud point exhibits good rinsing property.

As described above, according to the present invention, an alkali-type nonionic surfactant composition that exhibits good storage stability at relatively high temperatures, and a hard-surface cleaning agent consisting thereof can be provided. Moreover, the present invention can provide a method for cleaning a hard surface, a method for producing a substrate, a method for producing a recording medium, a method for producing a photomask and a method for producing a flat-panel display substrate, all performed using the aforementioned hard-surface cleaning agent. Furthermore, the present invention can provide, in connection with a nonionic surfactant-containing alkaline composition, a preservation method that can inhibit the deterioration of cleaning property when stored at relatively high temperatures.

INDUSTRIAL APPLICABILITY

A hard-surface cleaning agent consisting of the surfactant composition of the present invention is diluted as necessary, a hard surface is cleaned using the hard-surface cleaning agent or the diluted solution thereof, and thereby dirt such as fine particles adhering to recording medium substrates, photomasks, flat-panel display substrates and the like can be efficiently removed by cleaning, and highly cleaned hard surfaces can be obtained. Therefore, the present invention can contribute to the enhancement of a product yield.

The invention claimed is:

1. A method for producing a substrate comprising the step of cleaning a substrate to be cleaned that has a metal surface or a glass surface and that has undergone polishing of the surface using a polishing slurry by cleaning a hard surface with a hard-surface cleaning agent consisting of an alkali-type nonionic surfactant composition comprising:

a nonionic surfactant (component A), water (component B), at least one compound (component C) selected from the group consisting of benzenesulfonic acid, toluenesulfonic acid, dimethylbenzenesulfonic acid, hydroxybenzenesulfonic acid and salts thereof, at least one alkaline chemical (component D) selected from the group consisting of potassium hydroxide and sodium hydroxide, the alkali-type nonionic surfactant composition containing the nonionic surfactant (component A) in an amount of 0.5 to 20 wt % and having a pH at 25° C. of 13.5 to 14, wherein the hard-surface cleaning agent is supplied to the hard surface by immersing the hard surface in the hard-surface cleaning agent and/or injecting the hard-surface cleaning agent.

2. A method for producing a recording medium comprising a recording medium substrate and a magnetic layer disposed on one principal surface side of the recording medium substrate or magnetic layers disposed respectively on both principal surface sides thereof, the method comprising:

a substrate forming step of forming the recording medium substrate by performing on a substrate to be polished a polishing treatment and a cleaning treatment several times in this order, and a magnetic layer forming step of forming at least one of the magnetic layers, wherein, in carrying out the final run of the cleaning treatment that is performed several times, the polished substrate is cleaned using a hard-surface cleaning agent consisting of an alkali-type nonionic surfactant composition comprising:

a nonionic surfactant (component A), water (component B), at least one compound (component C) selected from the group consisting of benzenesulfonic acid, toluenesulfonic acid, dimethylbenzenesulfonic acid, hydroxybenzenesulfonic acid and salts thereof, at least one alkaline chemical (component D) selected from the group consisting of potassium hydroxide and sodium hydroxide, the alkali-type nonionic surfactant composition containing the nonionic surfactant (component A) in an amount of 0.5 to 20 wt % and having a pH at 25° C. of 13.5 to 14.

3. The method for producing a recording medium according to claim 2, wherein the recording medium substrate has Ni—P-containing layers as both outermost layers.

4. A method for producing a photomask comprising a glass substrate and a shading metal pattern layer disposed on one principal surface side of the glass substrate, the method comprising the steps of:

forming the glass substrate by performing on a substrate to be polished a polishing treatment and a cleaning treatment several times in this order, and forming the shading metal pattern layer on the glass substrate, wherein, in carrying out the final run of the cleaning treatment that is performed several times, the polished substrate is cleaned using a hard-surface cleaning agent consisting of an alkali-type nonionic surfactant composition comprising:

a nonionic surfactant (component A), water (component B), at least one compound (component C) selected from the group consisting of benzenesulfonic acid, toluenesulfonic acid, dimethylbenzenesulfonic acid, hydroxybenzenesulfonic acid and salts thereof, at least one alkaline chemical (component D) selected from the group consisting of potassium hydroxide and sodium hydroxide, the alkali-type nonionic surfactant composition containing the nonionic surfactant (component A) in an amount of 0.5 to 20 wt % and having a pH at 25° C. of 13.5 to 14.

5. A method for producing a flat-panel display substrate comprising a glass substrate and an electrode layer disposed on the glass substrate, the method comprising the steps of:

forming the glass substrate by performing on a substrate to be polished a polishing treatment and a cleaning treatment several times in this order, and forming the electrode layer on the glass substrate, wherein, in carrying out the final run of the cleaning treatment that is performed several times, the polished substrate is cleaned using a hard-surface cleaning agent consisting of an alkali-type nonionic surfactant composition comprising:

a nonionic surfactant (component A), water (component B), at least one compound (component C) selected from the group consisting of benzenesulfonic acid, toluenesulfonic acid, dimethylbenzenesulfonic acid, hydroxybenzenesulfonic acid and salts thereof, at least one alkaline chemical (component D) selected from the group consisting of potassium hydroxide and sodium hydroxide, the alkali-type nonionic surfactant composition containing the nonionic surfactant (component A) in an amount of 0.5 to 20 wt % and having a pH at 25° C. of 13.5 to 14.

* * * * *